US006913112B2

(12) United States Patent
Bogard

(10) Patent No.: US 6,913,112 B2
(45) Date of Patent: Jul. 5, 2005

(54) NOISE ATTENUATION ASSEMBLY

(75) Inventor: Joseph T. Bogard, Seymour, IN (US)

(73) Assignee: Arvin Technologies, Inc., Troy, MI (US)

( * ) Notice: Subject to any disclaimer, the term of this patent is extended or adjusted under 35 U.S.C. 154(b) by 75 days.

(21) Appl. No.: 10/358,511

(22) Filed: Feb. 5, 2003

(65) Prior Publication Data

US 2004/0149514 A1 Aug. 5, 2004

(51) Int. Cl.[7] ..... F01N 1/10

(52) U.S. Cl. ..... 181/252; 181/247; 181/248; 181/258

(58) Field of Search ..... 181/252, 247, 181/248, 258

(56) References Cited

U.S. PATENT DOCUMENTS 4,258,821 A * 3/1981 Wendt et al. ..... 181/202
4,267,899 A 5/1981 Wagner et al.
4,424,882 A 1/1984 Moller
4,930,597 A 6/1990 Udell
4,941,545 A 7/1990 Wilcox et al.
5,147,987 A 9/1992 Richardson et al.
5,168,132 A 12/1992 Beidl et al.
5,198,625 A * 3/1993 Borla ..... 181/248
5,293,743 A 3/1994 Usleman et al.
5,783,782 A 7/1998 Sterrett et al.
5,801,344 A 9/1998 Herold
5,844,178 A 12/1998 Lothringen
5,936,210 A * 8/1999 Borneby et al. ..... 181/264
5,984,045 A 11/1999 Maeda et al.
6,202,785 B1 3/2001 Hilling et al.

* cited by examiner

*Primary Examiner*—Shih-Yung Hsieh
(74) *Attorney, Agent, or Firm*—Carlson, Gaskey & Olds

(57) ABSTRACT

The present invention provides a noise attenuation assembly having at least one noise prevention pad disposed within an annular gap formed between a gas passage tube and an overlap tube. The noise prevention pad prevents the two tubes from coming in contact during thermal expansion of the tubes, and allows the tubes to contract without causing "tick and ping" noise, during a cool down.

16 Claims, 3 Drawing Sheets

NOISE ATTENUATION ASSEMBLY

BACKGROUND OF THE INVENTION

1. Field of the Invention

The present invention relates to a noise reduction assembly, particularly for use with an exhaust system of an engine.

2. Description of the Related Art

Automobile engines are generally constructed with an exhaust silencer or muffler unit connected with the exhaust gas passageway. Various muffler constructions have been suggested to reduce the exhaust noises associated with internal combustion engines without affecting the performance of the engine.

Another noise associated with the exhaust system of an engine is referred to as "tick and ping" noise. This noise is produced by thermal growth movement of two mating components, such as an exhaust pipe assembly, or exhaust silencer tubes, or a traditional round or bottle resonator. Usually, the components include a tube placed inside another tube or a tube having an end crimped or pinched over another tube. When the temperature of one or both tubes increases, due to various causes such as hot exhaust gas moving through one or both tubes, the tubes expand radially and lengthwise. The inner tube becomes in a tight contact with the outer tube, while the inner tube slides against the outer tube. When the temperature drops, the tubes contract, causing a movement that produces "tick and ping" noise.

It should also be observed that, tick and ping noise may be generated as the exhaust system temperature increases. However, the exhaust system temperature increases while the automobile is in operation. Accordingly, background noise associated with the operation of the automobile, road noise, or perhaps an operating radio, serve to obscure "tick and ping" noise as the exhaust system temperature increases.

In contrast, in the absence of background noise, the same noise generated upon cooling of the exhaust system may annoy consumers.

Traditional exhaust noise mufflers are effective over a part of the range of frequencies generated by internal combustion engines. A solution to the engine noise not removed by a traditional muffler is to connect a resonator, such as a bottle resonator, in series with the muffler where the bottle resonator is tuned to remove noise frequencies not removed by the muffler. However, the resonator may be the source of "tick and ping" noise, based on the traditional construction of the resonator, which requires a tube within a tube assembly, as described above.

Another example of ways to attenuate sound in the muffler is to use an absorptive fibrous material packed into sound absorption chambers in the muffler. For example, U.S. Pat. No. 4,396,090 shows a muffler in which each absorption chamber is completely filled with mineral wool. Although sound attenuation of certain higher frequency ranges is achieved using such chamber-filling materials, the manufacturing cost of such a design is high because of the large quantity of fibrous material needed to fill one or more of the muffler sound absorption chambers. In U.S. Pat. No. 4,930,597, a tubular sock made of a fibrous material placed around a louvered exhaust tube, provides a high-frequency noise attenuation filter.

The above known solutions to the engine noise do not address the problem of "tick and ping" noise generated from thermal expansion and contraction of exhaust system components. Therefore, there is a need to reduce the unpleasant "tick and ping" noise, coupled with reducing the engine noise.

SUMMARY OF THE INVENTION

The present invention provides a noise attenuation assembly having at least one noise prevention pad disposed within an annular gap formed between a gas passage tube and an overlap tube. The noise prevention pad prevents the two tubes from coming in contact during thermal expansion of the tubes, allowing gas to continue flowing through the gap. Thus, "tick and ping" noise does not occur when the tubes contract during a cool down.

In an embodiment of the present invention, the noise attenuation assembly includes a shell defining an interior chamber, a passage tube defining an inlet end coupled to a first end of the shell and an outlet end coupled to a second end of the shell. Within the interior chamber of the shell, an overlap tube concentric to and surrounding a portion of the passage tube is provided. The overlap tube and the overlap portion of the passage tube form an annular gap, which has a closed end and an open end in communication with the interior chamber. The overlap portion of the passage tube defines at least one opening in communication with the annular gap. The noise attenuation assembly further includes at least one noise prevention pad disposed within the annular gap. The noise prevention pad has a first surface in contact with the overlap portion of the passage tube, and a second surface in contact with the overlap tube. The noise prevention pad prevents the overlap portion of the passage tube and the overlap tube from coming in contact during thermal expansion of the tubes.

In one form of the present invention, the passage tube has an inner wall defining a gas passage, and an outer wall. One or more of noise prevention pad(s) may be disposed along the circumference of the outer wall of the passage tube, leaving a plurality of channels for sound communication with the chamber of the shell.

In another form of the present invention, the noise prevention pad is made of any suitable heat resistant material, such as steel wool, stainless steel wool, or a ceramic wool.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate several embodiments of the invention, and such exemplifications are not to be construed as limiting the scope of the invention in any manner.

DETAILED DESCRIPTION OF THE PRESENT INVENTION

The embodiments disclosed below are not intended to be exhaustive or limit the invention to the precise form disclosed in the following detailed description. Rather, the embodiments are chosen and described so that others skilled in the art may utilize its teachings.

Figure 1:
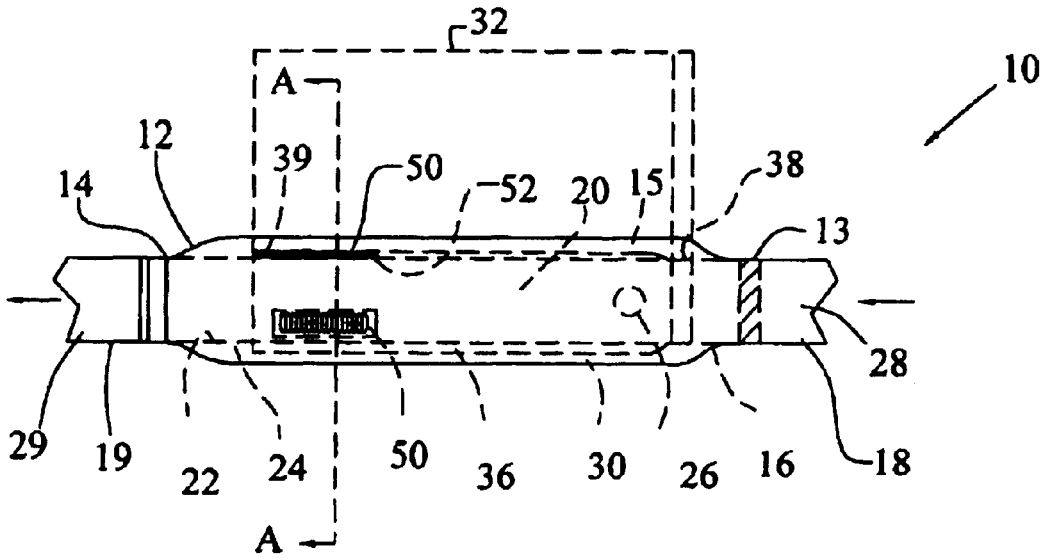
FIG. 1 is a schematic representation of a noise attenuation assembly according to an embodiment of the present invention.

Referring now to FIG. 1, noise attenuation assembly 10 has shell 12 defining an interior chamber 15, containing passage tube 16. Passage tube 16 has inlet end 18 extending outside of shell 12 from first end 13 of shell 12, and outlet end 19 extending outside of shell 12 from second end 14 of shell 12. Passage tube 16 further defines inner wall 22, outer wall 24, and at least one opening 26 extending from inner wall 22 to outer wall 24. First end 13 of shell 12 couples with passage tube 16 towards inlet end 18, and second end 14 of shell 12 couples with passage tube 16 toward outlet end 19, enclosing chamber 15. Inner wall 22 of passage tube 16 defines gas passage 20 extending from inlet end 18 to outlet end 19.

Noise attenuation assembly 10 further includes an overlap tube 30 concentric to and surrounding overlap portion 32 of passage tube 16. The length of overlap portion 32 may be adjusted to any suitable length for controlling the frequency of the attenuated sound. Overlap tube 30 has a closed end 38 coupled with passage tube 16, and an open end 39 open into chamber 15. Overlap tube 30 and overlap portion 32 of passage tube 16 form annular gap 36 in communication with gas passage 20 through opening 26, and in communication with chamber 15 through open end 39 of overlap tube 30.

Figure 2:
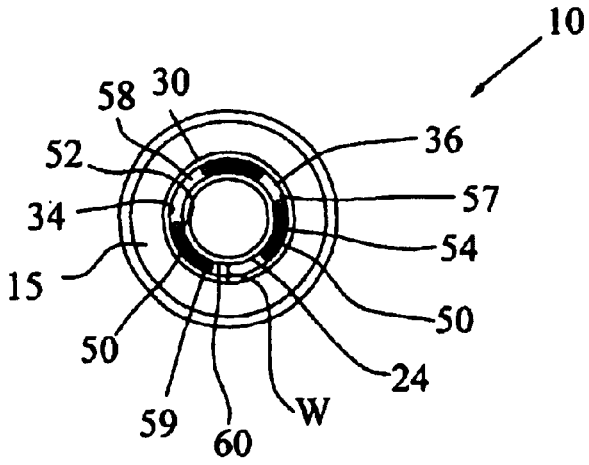
FIG. 2 is a schematic representation of a cross section a—a of the embodiment shown in FIG. 1.
Figure 3:
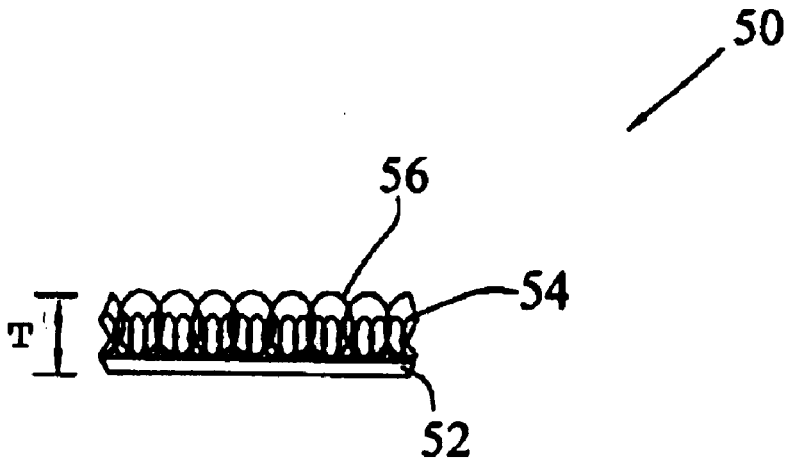
FIG. 3 is an embodiment of a noise prevention pad.

As illustrated in FIGS. 1–3, further included in noise attenuation assembly 10 is at least one noise prevention pad 50 disposed within gap 36. Noise prevention pad 50 has a first surface 52 attached to outer wall 24 of passage tube 16, and a second surface 54 in contact with inner wall 34 of overlap tube 30. As an example, shown in FIG. 2, there are three noise prevention pads 50 attached along the circumference of outer wall 24 of passage tube 16. The three noise prevention pads 50 are disposed between channels 57, 58 and 59, which communicate between annular gap 36 and chamber 15. It is possible to have any number of noise prevention pads 50 along the circumference of outer wall 24, depending on the sizes of noise prevention pad 50 and passage tube 16. Noise prevention pad 50 may be of any size and dimensions. For example, a rectangular pad of about 1.0 inch (2.5 cm) long and ½ inch (1.3 cm) wide may be used.

As depicted in FIG. 3, noise prevention pad 50 has thickness t, which is substantially equivalent to width w of annular gap 36 (see FIG. 2). A suitable thickness t is about 1.0 mm, although other thicknesses may also be appropriate. Noise prevention pad 50 may be made of any suitable heat resistant material, such as steel, or stainless steel, or ceramic. Second surface 54 of noise prevention pad 50 may have metallic wool-like construction 56 such as steel wool, stainless steel wool or ceramic wool. Wool-like construction 56 may be needle-shaped, or coiling. Any other suitable construction that is capable of flexing within the annular gap 36 may also be used.

Noise prevention pad 50 may be attached to outer wall 24 of passage tube 16 by any conventional means. For example, noise prevention pad 50 may be welded or spot welded to outer wall 24, or fastened by rivets to passage tube 16. Optionally the noise attenuation pad 50 may be attached to the inner wall 34 of the overlap tube 30.

Referring back to FIG. 1, noise attenuation assembly 10 may be connected to a catalytic converter assembly of an exhaust system, or downstream of a muffler assembly. The exhaust gas flows into noise attenuation assembly 10 through inlet 28 and out through outlet 29. A portion of gas flowing through gas passage 20 exits through opening 26 of passage tube 16 into gap 36 and is trapped in enclosed chamber 15. Sound waves exiting through opening 26 are also trapped within chamber 15 until they are extinguished. The length of overlap portion 32 of passage tube 16, the difference in diameters of passage tube 16 and overlap tube 30, and the number of openings 26, all contribute to the characteristics of the attenuated volume and frequency of the sound. All of these parameters may be adjusted to fit particular applications.

Figure 5:
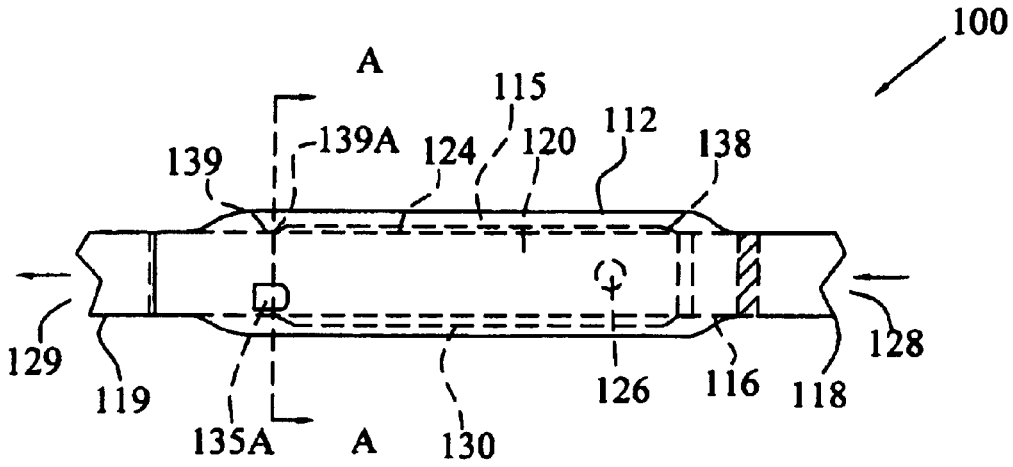
FIG. 5 (PRIOR ART)
FIG. 5 is a schematic representation of a noise attenuation assembly of prior art.
Figure 6:
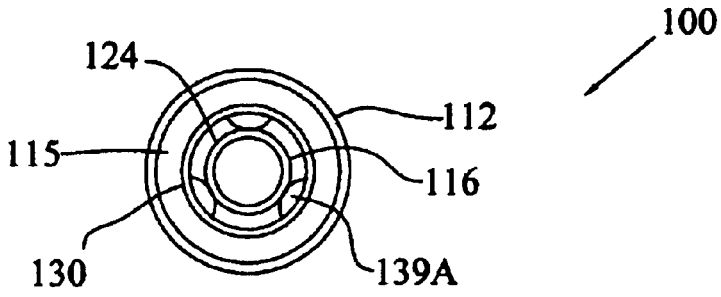
FIG. 6 (PRIOR ART)
FIG. 6 is a schematic representation of a cross section a—a of the noise attenuation assembly of prior art shown in FIG. 5.

In a traditional construction of prior art as shown in FIGS. 5–6, noise attenuation assembly 100 has overlap tube 130 surrounding passage tube 116. Overlap tube 130 has open end 139 spot welded to outer wall 124 at positions 139A. Closed end 138 of overlap tube 130 is crimped down on outer wall 124 of passage tube 116 or swaged around passage tube 116. Noise attenuation assembly 100 may be connected to the exhaust system of an engine for the purpose of attenuating the engine noise. While passing through passage tube 116 of noise attenuation assembly 100, the hot exhaust gas heats up passage tube 116. The temperature of the gas in passage tube 116 may reach 1400° F. (760° C.), while the temperature of overlap tube 130 may be 100–300° F. (37.8–93.3° C.) less than the passage tube 116, or 1300–1100° F. (593–704° C.). The difference of temperature between passage tube 116 and overlap tube 130 causes the tubes to expand unequally. Nominally, the overlap tube 130 is fastened to the passage tube 116 at both ends: by welding at 139A, and by swaging at closed end 138. Comparatively, swaging is less secure than welding. The relative temperature differential between the overlap tube 130 and the passage tube 116 results in displacement of the passage tube 116 with respect to the overlap tube 130 at the swaging at closed end 138. In fact, witness marks on the order of a millimeter have been observed at the swaging at closed end 138. The "tick and ping" noise is attributed to the relative movement of the passage tube 116 and the overlap tube at the swaging at closed end 138.

Referring back to FIGS. 1–2, noise attenuation assembly 10 of the present invention does not create the "tick and ping" noise. Since the open end 39 of overlap tube 30 is not welded to passage tube 16, the swaging at closed end 38 is relatively more secure than noise prevention pad 50 in the annular gap 36. Consequently, as the overlap tube 30 moves with respect to the passage tube 16, the movement is over the noise prevention pad 50. In addition, with noise prevention pad 50 disposed at open end 39 of overlap tube 30, passage tube 16 slides easily against overlap tube 30 during the lengthwise expansion. While passage tube 16 expands radially, wool-like construction 56 of noise prevention pad 50 flexes, keeping thickness t substantially the same as the reduced width w. When noise attenuation assembly 10 cools down, passage tube 16 contracts radially causing width w of annular gap 36 to expand. At the same time wool-like construction 56 expands to thickness t substantially equivalent to the expanded width w, keeping contact with both passage tube 16 and overlap tube 30.

Figure 4:
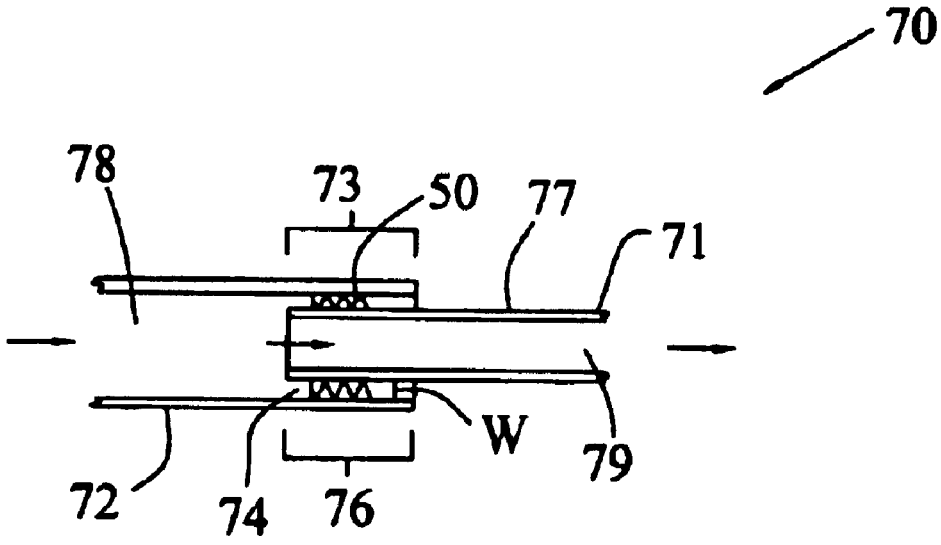
FIG. 4 is an embodiment of a pipe assembly.

In another embodiment of the present invention, as shown in FIG. 4, pipe assembly 70 includes inner pipe 71 having overlap portion 73 inserted into overlap portion 76 of outer pipe 72. Annular gap 74 is defined between overlap portion 73 and overlap portion 76. Pipe assembly 70 further includes at least one noise prevention pad 50 disposed within annular gap 74, keeping inner pipe 71 and outer pipe 72 at a distance substantially equivalent to width w of annular gap 74. Noise prevention pad 50 may be attached along the circumference of outer surface 77 of inner pipe 71. More than one noise prevention pad 50 are spaced such that channels (not shown) between noise prevention pads 50 are created, allowing a small amount of gas to flow through gap 74. Outer pipe 72 defines gas passage 78 in communication with gas passage 79 defined in inner pipe 71. Either inner pipe 71 or outer pipe 72 may be connected to and receive hot gas from a muffler assembly, such as an exhaust gas source. Pipe assembly 70 may include a shell (not shown) covering at least the overlap portions 73 and 76. For example, the shell may be a housing of a muffler.

As demonstrated in FIG. 4, the exhaust gas flows through passage 78 to passage 79 to be disposed or to be passed on to another component in the exhaust system. While flowing through pipes 71 and 72, the exhaust gas heats up pipes 71 and 72, causing overlap portions 73 and 76 to expand radially into gap 74 and lengthwise. Noise prevention pad 50 keeps overlap portions 73 and 76 from coming in direct contact. In addition, noise prevention pad 50 is capable of flexing, and thus helps overlap portion 73 to easily slide against overlap portion 76, when pipes 71 and 72 contract lengthwise and co-axially during cooling down. Consequently, "tick and ping" noise is not produced.

It is possible that pipe assembly 70 may be used within a muffler as part of a noise attenuation system to attenuate noise within a muffler. It is also possible to use pipe assembly 70 in a connection between components of the exhaust gas system to prevent "tick and ping" noise.

One advantage of the present invention is that the unpleasant "tick and ping" noise can be eliminated.

Another advantage is the pipe assembly can be used anywhere in the exhaust system that may cause "tick and ping" noise.

Yet another advantage is that the assembling of the components of the present invention is simple and not costly.

While the present invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A noise attenuation assembly comprising:

a shell defining an interior chamber;

a passage tube having an inlet end coupled to a first end of said shell and an outlet end coupled to a second end of said shell;

an overlap tube concentric to and surrounding an overlap portion of said passage tube, said overlap tube forming an annular gap with said overlap portion of said passage tube, said overlap portion of said passage tube defining at least one opening in communication with said annular gap, said annular gap having a closed end and on open end in communication with said interior chamber; and at least one noise prevention pad disposed within said annular gap, said at least one noise prevention pad having a first surface in contact with said overlap portion of said passage tube, and a second surface in contact with said overlap tube wherein said passage tube has an inner wall defining a gas passage and an outer wall having said at least one noise prevention pad attached thereon, said at least one noise prevention pad being spot welded to said outer wall of said passage tube.

2. The noise attenuation assembly of claim 1, wherein said at least one noise prevention pad comprises a plurality of noise prevention pads with each noise prevention pad being spaced along a circumference of said outer wall at said passage tube, forming a plurality of channels between said plurality of noise prevention pads.

3. The noise attenuation assembly of claim 1, wherein said at least one noise prevention pad is made of a heat resistant material.

4. The noise attenuation assembly of claim 3, wherein said at least one noise prevention pad includes a steel wool pad.

5. The noise attenuation assembly of claim 3 wherein said at least one noise prevention pad includes a stainless steel wool pad.

6. The noises attenuation assembly of claim 5, wherein said stainless steel wool pad defines fine needles protruding from said first surface.

7. The noise attenuation assembly of claim 3, wherein said at least one noise prevention pad is a ceramic material.

8. A pipe assembly comprising:

an inner pipe defining a first gas passage;

an outer pipe defining a second gas passage, said outer pipe having an overlap portion surrounding an overlap portion of said inner pipe, said second gas passage in communication with said first gas passage of said inner pipe, said overlap portion of said inner and said outer pipes forming an annular gap open at an overlap end of said outer pipe; and at least one noise prevention pad disposed within said annular gap keeping said overlap portions of said inner and said outer pipes from coming in contact wherein said inner pipe has an outer wall and said at least one noise prevention pad is attached thereon.

9. The pipe assembly of claim 8, wherein said at least one noise prevention pad is spot welded said outer wall said inner pipe.

10. The pipe assembly of claim 8, wherein said at least one noise prevention pad comprises a plurality of noise prevention that are each disposed along a circumference of said outer wall of said inner pipe, leaving a plurality of channels therebetween for sound communication.

11. A noise attenuation assembly comprising:

a first rigid tube defining a first gas passage;

a second rigid tube defining a second gas passage in fluid communication with said first gas passage, said second rigid tube surrounding at least a portion of said first rigid tube to define an overlap portion;

wherein said second rigid tube is spaced apart from said first rigid tube at said overlap portion to form an annular gap; and at least one noise prevention pad disposed within said annular gap wherein said at least one noise prevention pad is mounted to an external surface of said first rigid tube.

12. The noise attenuation assembly of claim 11 wherein said at least one noise prevention pad includes a first surface in direct contact with said first rigid tube and a second surface in direct contact with said second rigid tube.

13. The noise attenuation assembly of claim 11 wherein said at least one noise prevention pad is mounted to an internal surface of said second rigid tube.

14. The noise attenuation assembly of claim 11 wherein said at least one noise prevention pad includes a heat resistant material.

15. The noise attenuation assembly of claim 11 wherein said first and said second rigid tubes move relative to one another in response to changes in temperature.

16. The noise attenuation assembly of claim 15 wherein said second rigid tube has at least one tube end portion spaced apart from said first rigid tube and wherein said at least one noise prevention pad engages said first and said second rigid tubes to prevent contact between said first and second rigid tubes at said at least one tube end portion during relative movement between said first and said second rigid tubes resulting from changes in temperature.

* * * * *

UNITED STATES PATENT AND TRADEMARK OFFICE

CERTIFICATE OF CORRECTION

PATENT NO. : 6,913,112 B2
DATED : July 5, 2005
INVENTOR(S) : Bogard

It is certified that error appears in the above-identified patent and that said Letters Patent is hereby corrected as shown below:

Column 5,
Line 45, “on” should read as -- an --.
Line 60, “at” should read as -- of --.

Column 6,
Line 4, “noises” should read as -- noise --.
Line 25, please insert -- to -- after “welded” and before “said”.
Line 25, please insert -- of -- after “wall” and before “said”.
Line 29, please insert -- pads -- after “prevention” and before “that”.

Signed and Sealed this

Thirtieth Day of August, 2005

JON W. DUDAS
*Director of the United States Patent and Trademark Office*